US012240657B2

(12) United States Patent
Herlin et al.

(10) Patent No.: US 12,240,657 B2
(45) Date of Patent: Mar. 4, 2025

(54) PAPERBOARD PACKAGING CONTAINER AND LID

(71) Applicant: AR Packaging Systems AB, Lund (SE)

(72) Inventors: Henrik Herlin, Kristianstad (SE); Simon Holka, Staffanstorp (SE); Berth-Ola Göthe, Köpingebro (SE)

(73) Assignee: GPI Systems AB, Lund (SE)

( * ) Notice: Subject to any disclaimer, the term of this patent is extended or adjusted under 35 U.S.C. 154(b) by 1217 days.

(21) Appl. No.: 16/093,453

(22) PCT Filed: Apr. 13, 2017

(86) PCT No.: PCT/SE2017/050378

§ 371 (c)(1),
(2) Date: Oct. 12, 2018

(87) PCT Pub. No.: WO2017/180056

PCT Pub. Date: Oct. 19, 2017

(65) Prior Publication Data

US 2019/0127107 A1 May 2, 2019

(30) Foreign Application Priority Data

Apr. 15, 2016 (SE) ..... 1650512-5

(51) Int. Cl.
*B65D 3/14* (2006.01)
*B65B 1/02* (2006.01)
(Continued)

(52) U.S. Cl.
CPC ..... *B65D 3/268* (2013.01); *B65B 1/02* (2013.01); *B65B 1/04* (2013.01); *B65D 3/02* (2013.01);
(Continued)

(58) Field of Classification Search
CPC ..... B65D 2543/007; B65D 2543/0062; B65D 2543/0026; B65D 2543/00731;
(Continued)

(56) References Cited

U.S. PATENT DOCUMENTS 1,064,787 A * 6/1913 Taylor ..... B65D 3/14 4/258
1,396,282 A 11/1921 Penn
(Continued)

FOREIGN PATENT DOCUMENTS

CH 280201 A 1/1952
CN 88102720 A 11/1988
(Continued)

OTHER PUBLICATIONS

Machine Translation of JP S58-216539 A to Tomoo (Year: 1983).
(Continued)

*Primary Examiner* — Mollie Impink
(74) *Attorney, Agent, or Firm* — Womble Bond Dickinson (US) LLP

(57) ABSTRACT

The present disclosure provides a paperboard packaging container comprising a tubular paperboard container body, a container bottom and a container lid. The container body comprises a container body abutment edge at the container opening. The container body has an inner surface facing towards an inner compartment in the packaging container and an outer surface facing away from the inner compartment. The container lid comprises a lid collar having an abutment edge adapted for abutting against the container body abutment edge, and a lid plug-in portion. The plug-in portion has a side surface extending in the longitudinal direction and faces the inner surface of the container body, when the container lid is in a closed position. The lid collar is made of the same material as the container body and the
(Continued)

lid collar is delimited from the container body by a slit or by weakening means.

15 Claims, 6 Drawing Sheets

(51) Int. Cl.

| | |
|---|---|
| ***B65B 1/04*** | (2006.01) |
| ***B65D 3/02*** | (2006.01) |
| ***B65D 3/12*** | (2006.01) |
| ***B65D 3/26*** | (2006.01) |
| ***B65D 3/30*** | (2006.01) |
| ***B65D 43/02*** | (2006.01) |

(52) U.S. Cl.
CPC ..... *B65D 3/12* (2013.01); *B65D 3/14* (2013.01); *B65D 3/262* (2013.01); *B65D 3/30* (2013.01); *B65D 43/021* (2013.01); *B65D 43/0254* (2013.01); *B65D 2251/1041* (2013.01); *B65D 2543/00083* (2013.01); *B65D 2543/00268* (2013.01); *B65D 2543/0062* (2013.01); *B65D 2543/00648* (2013.01); *B65D 2543/00685* (2013.01); *B65D 2543/00694* (2013.01); *B65D 2543/00731* (2013.01); *B65D 2543/00805* (2013.01)

(58) Field of Classification Search
CPC ..... B65D 2543/00268; B65D 43/021; B65D 5/4291; B65D 3/262; B65D 3/28; B31F 1/08; B31F 1/009
See application file for complete search history.

(56) References Cited

U.S. PATENT DOCUMENTS 1,515,277 A 11/1924 Root
1,534,803 A 4/1925 Moore
1,733,674 A 10/1929 Leiman
2,073,636 A 3/1937 Holoubek
2,076,407 A 4/1937 Mandell
2,281,854 A 5/1942 Miller, Jr.
2,314,338 A * 3/1943 Graves ..... B65D 3/10 229/5.5
2,317,651 A 4/1943 Talbot
2,324,670 A 7/1943 Bergen
2,348,377 A 5/1944 Goodyear
2,371,173 A 3/1945 Hothersall
2,409,655 A 10/1946 Annen
2,568,697 A 9/1951 Amberg
2,569,851 A 10/1951 Farrell
2,608,341 A 8/1952 Eckman
2,760,629 A 8/1956 Thagard, Jr.
2,795,366 A 6/1957 Magill
2,832,514 A 4/1958 O'Connor
2,891,713 A 6/1959 O'Neil
2,898,025 A * 8/1959 Walker ..... B65D 5/12 229/4.5
2,948,454 A 8/1960 Gillmore
3,042,285 A 7/1962 Smith
3,042,288 A 7/1962 Carpenter, Sr.
3,049,277 A 8/1962 Shappell
3,101,885 A 8/1963 Walsh
3,109,576 A 11/1963 Karl
3,195,763 A 7/1965 Fried et al.
3,195,799 A 7/1965 Denenberg
3,391,852 A 7/1968 Waldrop
3,401,824 A 9/1968 Rouse
3,402,876 A 9/1968 Kuchenbecker
3,409,206 A 11/1968 Slouka et al.
3,445,049 A 5/1969 Carpenter, Jr.
3,506,183 A 4/1970 Turpin et al.
3,655,111 A * 4/1972 Surerus ..... B65D 47/36 220/834
3,669,346 A 6/1972 Leezer et al.
3,696,987 A * 10/1972 Schuff ..... B65D 21/0233 206/520
3,940,496 A 2/1976 Turpin et al.
4,078,686 A 3/1978 Karesh
4,091,929 A 5/1978 Krane
4,091,984 A 5/1978 McFarland
4,198,901 A 4/1980 Knudsen
4,207,725 A 6/1980 Smith
4,210,618 A 7/1980 Piltz
4,495,209 A 1/1985 Whiteside
4,533,063 A 8/1985 Buchner et al.
4,556,152 A * 12/1985 Bogren ..... B65D 77/30 220/276
4,606,462 A 8/1986 Bogren
4,621,736 A 11/1986 Roccaforte
4,632,298 A 12/1986 Schellengerg
4,720,038 A 1/1988 Shepard
4,736,870 A 4/1988 Christensson
4,804,101 A 2/1989 Heath
4,850,503 A 7/1989 Larsson
4,865,203 A 9/1989 Ueda
4,883,193 A 11/1989 Christensson
4,888,222 A 12/1989 Gibbons
4,921,121 A 5/1990 Duvander et al.
4,930,682 A 6/1990 Gordon et al.
5,407,107 A 4/1995 Smith
5,487,506 A 1/1996 Drummond et al.
5,511,680 A * 4/1996 Kinne ..... B65D 17/4011 220/791
5,514,394 A 5/1996 Lenahan
5,566,529 A * 10/1996 Sireix ..... B65D 3/262 53/449
5,617,705 A 4/1997 Sanfilippo et al.
5,641,118 A 6/1997 Benham
5,685,480 A 11/1997 Choi
5,752,646 A * 5/1998 Sandstrom ..... B65D 3/28 493/158
5,803,294 A 9/1998 Bello et al.
5,820,016 A 10/1998 Stropkay
5,897,019 A * 4/1999 Stropkay ..... B65D 43/021 220/669
5,950,917 A 9/1999 Smith
6,047,878 A * 4/2000 Lowry ..... B65D 3/262 229/125.05
6,092,717 A 7/2000 Lowry
6,165,114 A 12/2000 Stahlecker et al.
6,251,203 B1 6/2001 Vala et al.
6,325,232 B1 12/2001 Luttmann
6,415,940 B1 7/2002 Brabson, II
6,450,351 B1 9/2002 Thompson
6,644,541 B2 * 11/2003 Stewart ..... B65D 3/261 220/276
6,761,279 B1 7/2004 Martin et al.
7,169,418 B2 1/2007 Dalton
7,201,714 B2 4/2007 Zoeckler et al.
7,370,788 B1 5/2008 Otani et al.
7,703,625 B2 4/2010 Westphal
7,757,879 B2 7/2010 Schuetz
7,798,319 B1 9/2010 Bried
8,025,171 B2 9/2011 Cassol
8,220,701 B2 7/2012 Fontaine et al.
8,317,671 B1 11/2012 Zoeckler
8,403,819 B2 3/2013 Zoeckler
8,403,820 B2 3/2013 Zoeckler
8,684,224 B2 4/2014 House
8,915,395 B2 12/2014 Gersovitz
9,387,963 B2 7/2016 McBroom
9,718,574 B2 8/2017 Sireix
9,815,579 B2 11/2017 Larsson et al.
9,821,527 B2 11/2017 Hagelqvist
9,957,081 B2 5/2018 Gayer
9,975,305 B2 5/2018 Strand et al.
10,370,158 B2 8/2019 Herlin et al.
10,730,660 B2 8/2020 Herlin et al.
10,736,468 B2 8/2020 Herlin et al.

(56) References Cited

U.S. PATENT DOCUMENTS

| | | | | |
|---|---|---|---|---|
| 10,787,280 | B2 | 9/2020 | Herlin et al. | |
| 11,111,062 | B2 | 9/2021 | Herlin et al. | |
| 11,192,688 | B2 | 12/2021 | Herlin et al. | |
| 2002/0107127 | A1 | 8/2002 | Buisson | |
| 2002/0130126 | A1 | 9/2002 | Rosenberg | |
| 2003/0111522 | A1 | 6/2003 | Deering et al. | |
| 2003/0183540 | A1* | 10/2003 | Onishi | B65D 43/168 206/205 |
| 2004/0050437 | A1 | 3/2004 | Engel et al. | |
| 2004/0142133 | A1 | 7/2004 | De Coninck | |
| 2004/0206052 | A1 | 10/2004 | Shean | |
| 2004/0238553 | A1 | 12/2004 | Lane et al. | |
| 2005/0051461 | A1 | 3/2005 | Bryant | |
| 2005/0173501 | A1 | 8/2005 | Jones | |
| 2005/0189406 | A1 | 9/2005 | Welchel et al. | |
| 2005/0190995 | A1 | 9/2005 | Koyanagi | |
| 2005/0223680 | A1* | 10/2005 | Sireix | B65D 3/22 53/563 |
| 2005/0252952 | A1 | 11/2005 | Nomula | |
| 2006/0057315 | A1 | 3/2006 | De Coninck et al. | |
| 2006/0124719 | A1 | 6/2006 | Mannlein | |
| 2006/0254942 | A1 | 11/2006 | Cargile, Jr. | |
| 2006/0257534 | A1 | 11/2006 | Maddock | |
| 2006/0289542 | A1 | 12/2006 | Schedl | |
| 2007/0090105 | A1 | 4/2007 | Elgebrant | |
| 2007/0145001 | A1* | 6/2007 | Tilton | B65D 51/20 215/383 |
| 2007/0157577 | A1 | 7/2007 | Buisson | |
| 2007/0170236 | A1* | 7/2007 | Rasanen | B65D 43/022 229/404 |
| 2007/0234667 | A1 | 10/2007 | Lubker et al. | |
| 2007/0235512 | A1 | 10/2007 | Drummond | |
| 2008/0041861 | A1 | 2/2008 | Crawford et al. | |
| 2008/0110896 | A1 | 5/2008 | Westphal | |
| 2008/0156805 | A1 | 7/2008 | Perry et al. | |
| 2008/0156808 | A1* | 7/2008 | Perry | B65D 51/20 220/849 |
| 2009/0039078 | A1 | 2/2009 | Sanfilippo et al. | |
| 2009/0177179 | A1 | 7/2009 | Engelbrecht | |
| 2009/0236346 | A1 | 9/2009 | Hofeldt et al. | |
| 2009/0314775 | A1 | 12/2009 | Dietrich et al. | |
| 2010/0018883 | A1 | 1/2010 | Patel | |
| 2010/0065557 | A1 | 3/2010 | Gersovitz | |
| 2010/0108670 | A1 | 5/2010 | Perry et al. | |
| 2010/0133127 | A1 | 6/2010 | Jenner | |
| 2010/0140129 | A1 | 6/2010 | Sanfilippo et al. | |
| 2010/0142862 | A1 | 6/2010 | Sam | |
| 2010/0180553 | A1 | 7/2010 | Tilton | |
| 2010/0270301 | A1 | 10/2010 | Cronin | |
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2011/0006066 | A1 | 1/2011 | Vandamme et al. | |
| 2011/0240666 | A1* | 10/2011 | Mihaylov | B65D 43/022 220/796 |
| 2011/0253725 | A1 | 10/2011 | Killian | |
| 2012/0103353 | A1 | 5/2012 | Sebastian et al. | |
| 2012/0125932 | A1 | 5/2012 | Sierra-Gomez | |
| 2012/0298733 | A1 | 11/2012 | Xu et al. | |
| 2013/0029823 | A1 | 1/2013 | Zoeckler | |
| 2013/0048125 | A1 | 2/2013 | Hoffman et al. | |
| 2013/0092312 | A1 | 4/2013 | Cassoni | |
| 2013/0186901 | A1 | 7/2013 | Lejon et al. | |
| 2014/0109522 | A1 | 4/2014 | Sanfilippo | |
| 2014/0215973 | A1 | 8/2014 | Hagelqvist | |
| 2014/0262903 | A1 | 9/2014 | Mitten | |
| 2014/0287901 | A1 | 9/2014 | Hagelqvist | |
| 2015/0038309 | A1 | 2/2015 | Hoffman et al. | |
| 2015/0041470 | A1 | 2/2015 | Huffer et al. | |
| 2015/0099616 | A1 | 4/2015 | Chapman et al. | |
| 2015/0148208 | A1* | 5/2015 | Sireix | B65B 7/164 493/93 |
| 2015/0158632 | A1 | 6/2015 | Wilhelm | |
| 2016/0000270 | A1 | 1/2016 | Wiggins et al. | |
| 2016/0137377 | A1 | 5/2016 | Tracy | |
| 2017/0073142 | A1 | 3/2017 | Loomis et al. | |
| 2017/0247159 | A1 | 8/2017 | Hansen | |
| 2017/0283136 | A1 | 10/2017 | Branyon | |
| 2017/0297769 | A1 | 10/2017 | Gersovitz | |
| 2018/0016038 | A1 | 1/2018 | Herlin et al. | |
| 2018/0022505 | A1 | 1/2018 | Herlin et al. | |
| 2018/0170613 | A1 | 6/2018 | Hu | |
| 2018/0194527 | A1 | 7/2018 | Sasaki et al. | |
| 2018/0229907 | A1 | 8/2018 | Gayer | |
| 2018/0237206 | A1 | 8/2018 | Jobe | |
| 2018/0311940 | A1 | 11/2018 | Toft et al. | |
| 2019/0127100 | A1 | 5/2019 | Herlin et al. | |
| 2019/0127107 | A1 | 5/2019 | Herlin et al. | |
| 2019/0135508 | A1 | 5/2019 | Sunning et al. | |
| 2019/0256230 | A1 | 8/2019 | Holka | |
| 2021/0070520 | A1 | 3/2021 | Huffer | |
| 2021/0206544 | A1 | 7/2021 | Holka et al. | |
| 2022/0135260 | A1 | 5/2022 | Larsson | |
| 2022/0363427 | A1 | 11/2022 | Andersson | |
| 2023/0054953 | A1 | 2/2023 | Graham | |

FOREIGN PATENT DOCUMENTS

| | | | |
|---|---|---|---|
| CN | 1189804 | A | 8/1998 |
| CN | 1914096 | A | 2/2007 |
| CN | 2915695 | Y | 6/2007 |
| CN | 101391493 | A | 3/2009 |
| CN | 201338810 | | 11/2009 |
| CN | 101754912 | | 6/2010 |
| CN | 102190118 | A | 9/2011 |
| CN | 101670909 | B | 1/2012 |
| CN | 102991764 | A | 3/2013 |
| CN | 103895952 | A | 7/2014 |
| CN | 103979180 | A | 8/2014 |
| CN | 104812680 | A | 7/2015 |
| CN | 107108068 | A | 8/2017 |
| CN | 206954829 | U | 2/2018 |
| CN | 109153475 | A | 1/2019 |
| CN | 208559788 | U | 3/2019 |
| DE | 884862 | C | 7/1953 |
| DE | 3411371 | A1 | 10/1985 |
| DE | 10 2005 026903 | A1 | 8/2006 |
| DE | 10 2011 014 844 | A1 | 9/2012 |
| DE | 102014000543 | A1 | 7/2015 |
| EP | 0 013 132 | A1 | 7/1980 |
| EP | 0 062 929 | A2 | 10/1982 |
| EP | 0 094 359 | A2 | 11/1983 |
| EP | 0 104 548 | B1 | 6/1987 |
| EP | 0 312 513 | A2 | 4/1989 |
| EP | 0 370 982 | A1 | 5/1990 |
| EP | 0611703 | A2 | 8/1994 |
| EP | 0 820 936 | A2 | 1/1998 |
| EP | 1 052 181 | A1 | 11/2000 |
| EP | 1 818 259 | A2 | 8/2007 |
| EP | 1 842 792 | A1 | 10/2007 |
| EP | 1 035 025 | B1 | 3/2011 |
| EP | 2 716 551 | A1 | 4/2014 |
| EP | 2 719 637 | A1 | 4/2014 |
| EP | 2 731 874 | A1 | 5/2014 |
| EP | 2 927 132 | A1 | 10/2015 |
| EP | 3 085 636 | A1 | 10/2016 |
| EP | 3 095 600 | A1 | 11/2016 |
| EP | 3162553 | A1 | 5/2017 |
| EP | 3 409 470 | A1 | 2/2018 |
| EP | 3 342 720 | A1 | 7/2018 |
| EP | 3 442 875 | | 2/2019 |
| EP | 3 481 727 | | 5/2019 |
| EP | 3 546 387 | | 10/2019 |
| EP | 3 578 477 | | 12/2019 |
| FR | 828311 | A * | 5/1938 |
| FR | 1358396 | | 4/1964 |
| FR | 2716408 | A1 | 8/1995 |
| FR | 2 981 333 | | 4/2013 |
| FR | 2986514 | A1 | 8/2013 |
| FR | 3043069 | A1 * | 5/2017 |
| GB | 22536 | A | 10/1908 |
| GB | 190722536 | A | 10/1908 |
| GB | 191100947 | A | 12/1911 |

(56) References Cited

FOREIGN PATENT DOCUMENTS

| | | | |
|---|---|---|---|
| GB | 819960 | A | 9/1959 |
| GB | 920354 | A | 3/1963 |
| GB | 998102 | A | 7/1965 |
| GB | 1038995 | A | 8/1966 |
| GB | 2 281 895 | A | 3/1995 |
| GB | 2 453 869 | A | 4/2009 |
| GB | 2526548 | A1 | 12/2015 |
| JP | S58-216539 | A | 12/1983 |
| JP | S5962435 | A | 4/1984 |
| JP | S60501305 | A | 8/1985 |
| JP | S61217350 | A | 9/1986 |
| JP | S6375 | A | 1/1988 |
| JP | H0285118 | A | 3/1990 |
| JP | H05-58640 | U | 8/1993 |
| JP | H09-99939 | A | 4/1997 |
| JP | H09-290822 | A | 11/1997 |
| JP | 3025434 | B2 | 3/2000 |
| JP | 2000-203612 | A | 7/2000 |
| JP | 2001-030383 | | 2/2001 |
| JP | 2003-231191 | | 8/2003 |
| JP | 2004-001884 | A | 1/2004 |
| JP | 2004-018100 | A | 1/2004 |
| JP | 2004-026197 | A | 1/2004 |
| JP | 2004-155478 | A | 6/2004 |
| JP | 2004-315094 | A | 11/2004 |
| JP | 2004-535993 | | 12/2004 |
| JP | 2005-041515 | | 2/2005 |
| JP | 2005-219319 | | 8/2005 |
| JP | 2005-333802 | | 12/2005 |
| JP | 3843510 | B2 | 11/2006 |
| JP | 2007-145415 | A | 6/2007 |
| JP | 2010-284866 | A | 12/2010 |
| JP | 2015-174690 | | 10/2015 |
| JP | 2016-084169 | A | 5/2016 |
| JP | 2016-088524 | A | 5/2016 |
| JP | 2016-179849 | A | 10/2016 |
| JP | 2017-074951 | A | 4/2017 |
| JP | 2019-137067 | | 8/2019 |
| JP | 6596835 | B2 | 10/2019 |
| JP | 2020-039532 | A | 3/2020 |
| KR | 10-2007-0113467 | | 11/2005 |
| RU | 2 188 783 | C2 | 9/2002 |
| SE | 453821 | B | 3/1988 |
| SE | 1651162 | A1 | 3/2018 |
| SU | 1433404 | A3 | 10/1988 |
| WO | 8404511 | A1 | 11/1984 |
| WO | WO 87/03536 | A1 | 6/1987 |
| WO | WO 91/14623 | A1 | 10/1991 |
| WO | WO 03/039201 | | 5/2003 |
| WO | WO 2004/060767 | A1 | 7/2004 |
| WO | WO 2005/032959 | A1 | 4/2005 |
| WO | WO 2005/075314 | A2 | 8/2005 |
| WO | WO 2006/068585 | A1 | 6/2006 |
| WO | WO 2009/130043 | | 10/2009 |
| WO | WO 2020/211939 | A1 | 10/2010 |
| WO | WO 2011/052507 | A1 | 5/2011 |
| WO | WO 2013/009227 | A1 | 1/2013 |
| WO | WO 2013/057392 | A1 | 4/2013 |
| WO | WO 2013/109174 | A1 | 7/2013 |
| WO | WO 2014/011938 | A2 | 1/2014 |
| WO | WO 2014/062119 | A1 | 4/2014 |
| WO | WO 2015/145600 | | 10/2015 |
| WO | WO 2015/145601 | | 10/2015 |
| WO | WO 2015/187004 | A1 | 12/2015 |
| WO | WO 2016/030071 | A1 | 3/2016 |
| WO | WO 2016/034462 | A1 | 3/2016 |
| WO | WO 2016/126191 | A1 | 8/2016 |
| WO | WO 2016/126193 | A1 | 8/2016 |
| WO | WO 2017/180056 | A1 | 10/2017 |
| WO | WO 2018/009128 | A1 | 1/2018 |
| WO | WO 2018/009130 | A1 | 1/2018 |
| WO | WO 2018/009134 | | 1/2018 |
| WO | WO 2018/009136 | A1 | 1/2018 |
| WO | WO 2018/009138 | A1 | 1/2018 |
| WO | WO 2018/217156 | A1 | 11/2018 |
| WO | WO 2019/068384 | A1 | 4/2019 |
| WO | WO 2019/226097 | A1 | 11/2019 |
| WO | WO 2020/261170 | A1 | 12/2020 |

OTHER PUBLICATIONS

Machine Translation of WO 2019/068384 A1 (2019).

Chinese Search Report for Application No. 201780023817.2 dated Aug. 27, 2019, pp. 1-2.

Search Report for Application No. RU2018140095, dated Jul. 30, 2019, p. 1-2.

International Search Report for PCT/SE2017/050378, dated Jun. 19, 2017.

International Search Report for Swedish Application No. SE 1650512-5, dated Nov. 23, 2016.

* cited by examiner

PAPERBOARD PACKAGING CONTAINER AND LID

CROSS-REFERENCE TO RELATED APPLICATIONS

This application is a national phase entry under 35 U.S.C. § 371 of International Application No. PCT/SE2017/050378 filed on Apr. 13, 2017, which claims priority to Swedish Patent Application No. 1650512-5 filed on Apr. 15, 2016, the disclosures of which are incorporated herein by reference.

TECHNICAL FIELD

The present disclosure pertains to a paperboard packaging container for bulk solids and a method for producing the same. More specifically, the present disclosure pertains to a paperboard packaging container comprising a reclosable container lid. Moreover, the present disclosure pertains to a method of producing the paperboard packaging container.

BACKGROUND OF THE INVENTION

When packaging consumer goods, and in particular when packaging dry flowable pulverulent consumer goods it is common to use rigid paperboard packaging containers which serve as protective transport and storage containers at the retail end and as storage and dispensing containers at the consumer end. Such paperboard containers are usually provided with an openable and closable lid, and may be provided with an inner removable or breakable barrier membrane which keeps the contents fresh and protected against contamination up until to the container is opened by a consumer. Once the inner barrier has been destroyed in order to access the contents in the packaging container, the ability of the packaging container to protect the contents from detrimental influence from the environment depends strongly on the closure construction. Accordingly, it is a concern that the packaging container can be adequately closed and can continue to keep the contents in the packaging container fresh and protected against contamination from the outside also after the inner barrier has been removed. It is a particular concern that the packaging container may be repeatedly opened to access the contents in the container and be re-sealed to allow hygienic storage of the contents in the package between dispensing occasions. A packaging container for bulk solids usually contains more of the packaged product than will be used at each dispensing occasion. Thus, it is desirable that the product remaining in the packaging container retains properties such as flavor, scent, scoopability, vitamin content, color, etc. at least for a time period corresponding to the time it is expected it will take for a consumer to use up all the contents in the packaging container.

There is also high consumer awareness and demands with regards to hygienic storage for paperboard packaging containers and a demand for paperboard packaging containers which provides the consumers with an impression and assurance that the paperboard packaging container is properly reclosed after use.

This is an even more important concern for a packaging container made entirely of paperboard, i.e. without using plastic rims or plastic locking arrangements which may aid in improving tightness when closing the container but which make the packaging container more expensive to manufacture and more difficult to recycle. A packaging container made entirely of paperboard may over time and as a result of repeated opening and closing lose some of its rigidity at the opening end. Furthermore, such packaging containers are difficult to provide with an indication of proper reclosing, such as by means of a click sound.

It is therefore an object of the present invention to offer an all-paperboard packaging container having an improved closure arrangement.

SUMMARY OF THE INVENTION

The above and other objects may be provided by a paperboard packaging container according to claim 1. Further embodiments are set out in the dependent claims, in the following description and in the drawings.

As such, the present disclosure relates to a paperboard packaging container for bulk solids. The paperboard packaging container comprises a tubular paperboard container body, a container bottom and a container lid. The container body extends in a longitudinal direction of the packaging container from a bottom end of the container body to a container opening. The container body comprises a container body abutment edge at the container opening. The container body has an inner surface facing towards an inner compartment in the packaging container and an outer surface facing away from the inner compartment. The container lid comprises a lid collar having an abutment edge adapted for abutting against the container body abutment edge, and a lid plug-in portion. The plug-in portion has a side surface extending in the longitudinal direction and faces the inner surface of the container body, when the container lid is in a closed position. The plug-in portion further comprises a main surface being located at a distance from the container body abutment edge when the container lid is in a closed position. The lid collar is made of the same material as the container body and the lid collar is delimited from the container body by a slit or by weakening means extending along the container body periphery for allowing the lid collar to be fully or partially separated from the container body at the abutment edges. The shape of the container opening is stabilized, either by (i) the paperboard packaging container comprising a partially removable transport closure attached to an inner surface of the container body and forming a roof over the inner compartment and/or (ii) by that the container body comprises a multi-ply paperboard material including one or more layers of a polymeric film, a coating layer and/or metal foil. The paperboard packaging container is furthermore provided with a locking arrangement for retaining the container lid in the closed position. The locking arrangement comprises a first locking element in the form of a recess, provided on the inner surface of the container body, and a second locking element in the form of a protrusion, provided on the side surface of the lid plug-in portion, the first and second locking elements being mating locking elements. The first and second locking elements are arranged such that when the container lid is in the closed position the protrusion is in engagement with the recess.

The fact that the container lid is provided with a lid collar comprising an abutment edge adapted for abutting against the container body abutment edge and a lid plug-in portion provides the packaging container with a storing tightness while the container lid is in a closed position.

As the paperboard packaging container, including the container lid and the plug-in portion, are co-formed in the manufacturing procedure from one paperboard material sheet and the lid collar is delimited from the container body by a slit or by weakening means, the lid collar and the container body abutment edges will be substantially perpendicular to the container wall and the cross sectional area of the plug-in portion, i.e. normally the surface area of the main surface of the plug-in portion, will be substantially equal to the cross sectional area of the container opening. This will contribute to improved sealing properties and produce a more distinct click sound upon closure of the container lid compared to if the edges would have been slanted or profiled and if the plug-in portion would have had a smaller cross-sectional area compared to the container opening.

The lid collar thus forms a contiguous continuation of the container body wall and the plug-in portion has the function of a plug, fitting tightly in the container opening in close contact with the inner surface of the container body. The locking arrangement assures that the container remains closed, and the protrusion on the side surface of the plug-in surface will require the user to push the plug-in portion of the lid downwards in a fairly determined and forceful manner in order to overcome the resistance created as the protrusion is moved past the edges of the container wall. Accordingly, the abutment edge of the top member will hit the container body abutment edge with an increased force and thereby provide the consumer with an enhanced closure indication, such as a sensory snap-in indication and the audible signal e.g. in the form of a click sound, signalling to the user that the container is properly closed, which improves the user-experience with regards to the perception of a properly sealed container.

The fact that the main surface of the plug-in portion is located at a distance from the container body abutment edge when the container lid is in a closed position means that the main surface of the plug-in portion is located below the container body abutment edge, i.e. the main surface is positioned closer to the bottom end of the container body with respect to the abutment edge in a longitudinal direction of the container body.

The container lid may be closed by pressing the plug-in portion into the container opening until the protrusion snaps into the recess and the lid collar abutment edge is closed against the container body abutment edge, which may be indicated to the user by a feeling of a slight resistance having to be overcome when pressing the lid in place, a snap-in or slide-in sensation and/or an audible signal such as a click sound or a squeaking or scratching sound being produced when the lid is closed on the container body. It may be generally preferred that a closure indication is provided as distinct sensation or sound, or a combination of a distinct sensation or sound as such signals may be perceived as providing a more definitive confirmation of a proper closing than an indistinct sensation or sound. Examples of distinct sensations are snap-in sensations while click or pop sounds may provide distinct sound sensations.

The production of a distinct audible click sound in an all paperboard packaging container as disclosed herein can be achieved by providing the packaging container with female/male mating locking elements as disclosed herein. The sound arises when the locking elements snap into locking engagement and may be enhanced by providing the locking elements as elongated elements having a length of 5% or more of the periphery of the inner surface of the container body and the side surface of the plug-in portion, respectively. The sound may be further enhanced by arranging elongated elements at curved corner portions of the packaging container and by selecting a height/depth of the locking elements which increases the force required to bring the locking elements into engagement with each other. A further contribution to an audible signal may be provided by the abutment edges being slammed together when pushing the lid into the container body opening.

By a "partly removable transport closure" is meant a closure that may be partly removed by a user, such as by peeling or tearing in order to provide initial access to an interior compartment of the packaging container. After the transport closure has been opened and partially removed, an edge portion, such as a transport closure peripheral flange which is flexed towards the top end or towards the bottom end and attached to the inner surface of the container body, of the transport closure will, at least partly, remain attached to the inner wall of the container body. The remaining part of the transport closure will contribute to stabilizing the container opening which is important to prevent deformation of the cross-sectional shape of the packaging container and to prolong the provision of a closure indication upon repeated closings of the container lid. The remaining part may be provided along 25% to 100% of the periphery of the inner surface of the container body, such as along 50% to 80% of the periphery of the inner surface of the container body, or along 60% to 80% of the periphery of the inner surface of the container body.

The transport closure may be gastight or gas-permeable. A gastight closure may be manufactured from any material or material combination suitable for providing a gastight sealing of a compartment delimited by the transport closure, such as aluminium foil, silicon-coated paper, plastic film, or laminates thereof. In an all paperboard packaging container as disclosed herein, it is generally preferred that the transport closure is made of paperboard material or paper. A gastight transport closure is advantageous when the bulk solids stored in the packaging container are sensitive to air and/or moisture, and it is desirable to avoid contact of the packaged bulk solids with ambient air.

The transport closure should be provided at a sufficient distance from a container body abutment edge at said upper end to allow the container lid comprising the plug-in portion to be in a closed position, meaning that this distance should be equal to or larger than the height of the plug-in portion.

Optionally, the transport closure may be a paperboard transport closure.

Optionally, the paperboard packaging container may comprise a peripheral edge portion partly or fully surrounding a tear-open part, wherein the tear-open part is delimited to the peripheral edge portion by a tear line. The tear-open part may be provided with a push or pull tab for gripping and removal of the tear-open part, leaving the peripheral edge portion attached to the inner surface of the container body and the peripheral edge portion protruding horizontally from the inner surface into the container opening. The width of the edge portion, as measured from the inner surface of the container body, may be from about 2 to 8 mm.

The transport closure may also be provided with cuts, forming a tear strip and a tear-away area which includes the tear strip. By pulling at the tear-strip formed in the top member, the connection or connections between the top member and the bottom member within the area constituted by the tear strip will cause the bottom member to break along the cuts in the top member. Thereby, both the top member and the bottom member within the tearable area can be removed from the container and to make the contents in the container available for use.

Optionally, the mating locking elements are in the form of an elongated continuous or discontinuous protrusion and a corresponding elongated continuous or discontinuous recess. The mating locking elements may be provided along 5%-100%, of the periphery of the inner surface of the container body and the side surface of the plug-in portion, respectively, such as along 25%-100%, of the periphery of the inner surface of the container body and the side surface of the plug-in portion, respectively, along 50%-100%, of the periphery of the inner surface of the container body and the side surface of the plug-in portion, respectively, along 75%-100%, of the periphery of the inner surface of the container body and the side surface of the plug-in portion, respectively.

The fact that the mating locking elements are in the form of an elongated continuous or discontinuous protrusion and an elongated continuous or discontinuous recess and that the mating locking elements are provided along 25%-100% of the periphery of the inner surface of the container body and the side surface of the plug-in portion, such as from 50% to 100% of the periphery of the inner surface of the container body and the side surface of the plug-in portion, gives an improved reclosing functionality along an extended part of the container body periphery.

Optionally, the paperboard packaging container comprises at least two locking arrangements being spaced apart in said longitudinal direction, such as three locking arrangements being spaced apart in said longitudinal direction.

The locking arrangement, besides providing the packaging container with an improved reclosing functionality, provides the all-paperboard packing container with an improved seal as the protrusion and recess additionally functions as a barrier between the plug-in portion and the inner surface of the container body.

The fact that the paperboard packaging container comprises at least two locking arrangements being spaced apart in said longitudinal direction provide a further improved re-closing functionality and has additionally been found to provide a substantially improved sealing functionality to the packaging container, both in terms of increased protection against detrimental influence from the environment and against leakage from the content provided in the packaging container if the container falls or overturn. This is believed to be due to the fact that the first of the two or more locking arrangements provides a substantial sealing functionality, such that when the second or third locking arrangement is exposed to the possible leakage of powder or detrimental influence from the environment for example, which has leaked over the first locking arrangement, the protection provided by the second or third locking arrangement becomes in principle complete.

A packaging container may be provided with two or more locking arrangements being spaced apart in said longitudinal direction at the inner surface of the container body and the side surface of the plug-in portion respectively, wherein the mating locking elements in each of the locking arrangements are in the form of an elongated continuous or discontinuous protrusion and a corresponding elongated continuous or discontinuous recess, and wherein the mating locking elements may be provided along 5%-100%, of the periphery of the inner surface of the container body and the side surface of the plug-in portion, respectively, such as along 25%-100%, of the periphery of the inner surface of the container body and the side surface of the plug-in portion, respectively, along 50%-100%, of the periphery of the inner surface of the container body and the side surface of the plug-in portion, respectively, along 75%-100%, of the periphery of the inner surface of the container body and the side surface of the plug-in portion, respectively.

The width of the elongated continuous or discontinuous mating locking elements as measured perpendicular to the longitudinal extension of the locking elements may be from 2 to 15 mm.

Optionally, a recess, such as an elongated recess has a depth of between 0.1 and 3.0 mm, such as between 0.2 mm and 3.0 mm, as measured from the side surface of the plug-in portion or from the inner surface of the container body, and a mating protrusion such as an elongated protrusion has a height of between 0.1 and 3.0 mm, such as between 0.2 mm and 3.0 mm, as measured from the side surface of the plug-in portion or from the inner surface of the container body to the protrusion tip, and that the depth is at least equal to the height.

Optionally, the first and second mating locking elements, in the form of a recess and a mating protrusion, form a snap lock connection.

Optionally, the first locking element and second locking elements are in the form of physical deformations of the paperboard material provided on the inner surface of the container body and the side surface of the plug-in portion, respectively.

The first and second locking elements are thus not provided by means of additional material or separately added parts to the paperboard packaging material, such as for example in the form of corresponding plastic rims, but are integrally formed with the container body and the lid and are provided by a simultaneous deformation of the inner surface of the container body and the side surface of the plug-in portion of the lid.

In a packaging container as disclosed herein, the lid may be arranged to be completely removed when opening the container. When the container lid is a completely removable lid, the lid is free from permanent connections to the container body. For the lid collar, and thus the container lid, to be fully separable from the container body, the slit or the weakening means should extend along 100% or substantially 100% of the container body periphery.

By "slit" is meant a continuous slit provided around the container body periphery and by "weakening means" is meant that the container body is provided with a series of discontinuous slits, perforations or the like, allowing rupture of the container body wall at a predefined location. A separation between the container body and the lid collar which is provided by weakening means, may serve as tamper evidence at delivery of the packaging container to a consumer.

Alternatively, the container lid may be of the type which is opened by pivoting the lid about a hinge. Optionally, a hinge is provided between the container lid and the container body, the hinge comprising or consisting of a remaining part of the periphery not comprising the slit or the weakening means. In a packaging container being provided with weakening means between the container body and the lid collar a user may choose to leave a portion of the weakening means unbroken when opening the packaging container, thus creating a remaining connection between the lid collar and the container body which remaining connection will serve as a hinge.

A hinge facilitates a more precise positioning of the lid in the container opening as the lid is held in position by the hinge. This allows the user to close the lid more firmly and distinct as no positioning of the plug-in portion into the container opening is needed, which leads to a more distinct clicking sound upon closure.

A hinge may be further accentuated by the provision of flexure enhancement means in the unbroken connection between the lid collar and the container body such as an embossed line or an opening arranged in the hinge part of the dividing line between the lid collar and the container body. Optionally, the hinge comprises a hinge crease line.

The fact that the remaining part of the periphery not comprising the slit or the weakening means comprises a hinge crease line facilitates opening by means of the hinge and that the remaining part of the periphery not comprising the slit or the weakening means is flexed and opened at a predefined location.

For the lid to be partially separated and opened by means of a hinge provided between the container lid and the container body at the slit or the weakening means should extend along at least 55% of the container body periphery.

If the slit or the weakening means extend along from 10% to 50% of the container body periphery the container lid is only partially openable, such as by means of the main surface of the plug-in portion comprising a pivotable hinged lid portion and the side surface of the plug-in portion being provided with slits to allow separation of the pivotable hinged lid portion.

Optionally, the hinge is constituted of from 5% to 25% of the periphery of the container body, such as from 10% to 20% of the periphery of the container body.

Optionally, the locking arrangement and the hinge are arranged at opposite sides of the container opening, meaning that the locking arrangement is arranged on an opposite side of the container opening with respect to the hinge.

The fact that the first and second mating locking elements are arranged on an opposite side of the container opening with respect to the hinge, gives an improved indication to the user of the packaging container that the packaging container has been properly reclosed as an increased force is needed to press down the container lid at the location of the first and second mating locking elements which may enhance a click sound obtained upon re-closure.

Furthermore, a symmetrical placement of the hinge and the locking elements has been found to improve stability and durability of the packaging container by reducing the risk of the lid being pressed into the container opening in a skewed way, thereby causing the container edge to become deformed.

The packaging container may have an essentially cuboid shape such that the cross-section of the container body of the packaging container according to the present invention may have a rectangular or modified rectangular shape, wherein the container body comprises opposing front and rear wall portions, opposing side wall portions and corner portions. The front and the rear wall portions may be wider than the opposing side wall portions. The cross-sectional length may be at least about 1.3 times greater than the cross-sectional width, such as from about 1.3 to 2.5 times greater than the cross-sectional width.

As used herein, the term "cuboid" refers to a polyhedron having rectangular or generally rectangular faces. The cuboid may have rounded or bevelled edges. In a modified rectangular cuboid shape the opposing front and rear walls may for example be convex or slightly convex, while the opposing transverse walls may be straight.

Optionally, the corner portions are curved corner portions. For a packaging container made entirely of paperboard material curved corner portions may be preferred, as the curved corner portions contribute to increasing the rigidity and shape stability of the packaging container.

The cross-section of the container body of the packaging container may alternatively have any suitable cross-sectional shape, such as essentially a round, oval, race-track shaped or triangular shaped.

It has been found that by making one or more container walls only slightly outwardly curved, shape stability and rigidity of the packaging container may be considerably improved as compared to conventional packaging containers having planar walls. Container walls having improved shape stability and rigidity implies that increased force is needed to press the container lid plug-in portion into the container opening when a protrusion is provided either at a portion of inner surface of the container body or on the side surface of the plug-in portion.

Optionally, the hinge, provided between the container lid and the container body, is arranged at one of said side wall portions.

The provision of the hinge at one of the side wall portions and the first locking element, at least, at the opposing side wall portion has been found to improve the audible closure indication when the cross-sectional length between the hinge and the opposing side wall is greater than the cross-sectional width, such that at least 20% greater, or at least 50% greater, or at least 100% greater. Optionally, the cross-sectional length is not more than 350% greater than the cross-sectional width. This effect on the audible closure indication is due to that the distance for the container lid from an open to a closed position will be larger and the force used to close the lid will increase and thereby also the force by which the abutment edges hits each other.

The container wall portions, such as the front and rear wall portions of the container body and/or the side walls portions, may have an outwardly curved shape with a radius of curvature of 30-1000 mm, preferably 30-500 mm, more preferably 35-400 mm, respectively.

Optionally, the front and the rear wall portions of the container body have an outwardly curved shape with a radius of curvature of 30-1000 mm, preferably 30-500 mm, more preferably 35-400 mm, respectively, while the side edges are substantially planar.

Optionally, the first locking elements are arranged on the inner surface of the container body in in one or more of the curved corner portions.

When arranging the first locking element on the inner surface of the container body in one or more of the curved portions, the improved stability of this portion may contribute to an improved indication of proper re-closing to the consumer. This is due to the increased force needed to press the container lid plug-in portion into the container opening when the locking arrangement is provided at a portion of the container body with an elongated locking element being bent to follow the curvature of the corner portion, and a corresponding curved portion and curved elongated locking element of the plug-in portion, are provided on surfaces with enhanced rigidity.

The elongated locking elements, and in particular elongated locking elements arranged at curved corner portions of the container body have also been found to have a stabilizing effect on the container opening thereby reducing wear and deformation of the container opening edge over time.

The corner portions of the packaging container may be curved corner portions having a radius of curvature of 10-65 mm, preferably 15-65 mm, more preferably 15-30 mm.

Optionally, the first locking elements are arranged on the inner surface of the container body in in one or more of the two side wall portions.

The fact that the locking elements are arranged on the inner surface of the container body in one or more of the two side wall portions may increase the may contribute to an improved indication of proper re-closing to the consumer. This is due to the fact that the side wall portions have a higher rigidity compared to the longer front and rear wall portions, which increases the force needed to press the container lid plug-in portion into the container opening.

Optionally, the two side wall portions have an outwardly curved shape with a radius of curvature of 30-1000 mm, preferably 30-500 mm, more preferably 35-400 mm, respectively. The side wall portions may also be straight or substantially straight.

The fact that the entire packaging container is made of paperboard material makes the container recyclable as a whole and as a single unit since the whole container is made of the same, or at least the same kind of, material. There is thus no need to rip the container apart and sort the material to be recycled into different fractions.

The container lid of the paperboard packaging container may be provided with a grip tab, to facilitate opening of the container lid. The container lid may otherwise be harder to open as the plug-in portion and the locking elements improve the sealing properties and consequently increases the resistance to opening the container lid.

Optionally, the side surface of the plug-in portion has a height (h1) of between 10-50 mm, as measured from the main surface of the plug-in portion to the abutment edge of the lid collar.

The fact that the side surface of the plug-in portion has a height (h1) of between 10-50 mm provides the container lid with a plug-in portion which gives a satisfactory sealing functionality, while at the same time being easy and effective to press down into the container body opening. The height of the side surface of the plug-in portion of the lid must also have a sufficient size to accommodate a first and a second mating locking element which will fulfil the purpose of the present disclosure.

As used herein, a paperboard packaging container is a packaging container wherein the container body is formed from paperboard web material. An all paperboard packaging container, as disclosed herein, is a paperboard container which is entirely made from paperboard material and which, specifically does not include components such as a plastic rim or other plastic parts. The paperboard container may be formed in any manner known in the art, e.g. by forming a container body by bending a paperboard web material into a tubular shape and longitudinally closing the tube by joining overlapping or abutting side edges of the paperboard material. The join between the side edges may be covered by a sealing strip. Preferably, the paperboard packaging container is formed by the method as disclosed herein. The container bottom may be formed from a separate bottom disc which is attached at one end of the container body tube or may be formed by folding an end portion of the container body tube.

As used herein, a paperboard material is a sheet material predominantly made from cellulose fibers or paper fibers. The sheet material may be provided in the form of a continuous web or may be provided as individual sheets of material. The paperboard material may be a single ply or multi ply material and may be a laminate comprising one or more reinforcing, moisture resistant non-cellulosic layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

The plug-in portion of the lid may be formed of a multi-ply paperboard material including one or more layers of a polymeric film, a coating layer and/or metal foil. This may increase the stability of the material and decrease the tendency to deform, such that the protrusion provided on the side edge of the plug-in portion is not deformed after repeated openings and closing of the container lid.

As used herein, the term "bulk solids" refers to a solid material. The bulk material may be dry or moist. The bulk solids may be in the form of particles, granules, grinds, plant fragments, short fibres, flakes, seeds, formed pieces of material such as pasta, etc. The bulk solids which are suitable for packaging in the packaging containers as disclosed herein may be flowable, which means that a desired amount of the product may be poured or scooped out of the packaging container, or in the form of discreet pieces of material allowing removal of only part of the content in the packaging container.

The paperboard packaging container as disclosed herein may be a container for alimentary products such as infant formula, coffee, tea, rice, pasta, flour, sugar, cereals, soup powder, custard powder, or the like. Alternatively, the bulk solids may be non-alimentary, such as tobacco, detergent, fertilizer, chemicals or the like.

The objects of the present disclosure may also be achieved by a method of producing a paperboard packaging container according to the appended claims.

As such, the present disclosure also relates to a method of producing and filling a paperboard packaging container with bulk solids. The method comprises the steps of;

a) bending a paperboard sheet material into a tube having a longitudinal direction, a radial direction perpendicular to the longitudinal direction, and a circumferential direction and closing the tube in the longitudinal direction by joining overlapping or abutting side edges of the paperboard material. The closed tube has a top end and a bottom end and comprises a container body portion and a lid collar portion. The lid collar portion is arranged at the top end and is delimited from the body portion by a dividing line extending in the circumferential direction between the body portion and the lid collar portion;

b) imparting a predetermined cross-sectional shape to the tube;

c) closing the tube at the top end by pressing a transport closure into the tube at the top end or at the bottom end, the transport closure having a transport closure peripheral flange which is flexed towards the top end or towards the bottom end, the transport closure being a partially removable transport closure;

d) attaching the transport closure peripheral flange to the inner surface of the container body portion at a distance from the top end;

e) pressing a paperboard top disc into the tube at the top end, the top disc having a peripheral flange being flexed towards the top end in the longitudinal direction, the flexed peripheral flange extending in the longitudinal direction across the dividing line with an attachment portion positioned at the lid collar portion and a plug-in portion positioned at the container body portion;

f) attaching the attachment portion of the peripheral flange of the paperboard top disc to an inner surface of the lid collar portion of the tube;

g) forming a locking arrangement by providing the container body portion with a first locking element and providing the plug-in portion with a second locking element, the first and second locking elements being mating locking elements comprising or consisting of a protrusion and a recess, the mating locking elements being formed by physically deforming the paperboard material in the container body portion and the plug-in portion in the radial direction;

h) arranging a slit or weakening means extending along from 10-100%, such as along from 55-100%, such as along 75-100%, of the dividing line, the slit or weakening means being arranged along the dividing line before or after forming the tube; the process further comprises the steps of;

i) filling bulk solids into the container body portion; and j) closing the bottom end of the tube, wherein the filling step i) is carried out either by filling from the top end after closing the bottom end in step j) and before closing the tube at the top end in step c), or by filling from the bottom end after attaching the transport closure in step d), and before the closing step j).

When the filling step i) is carried out by filling from the bottom end after attaching the transport closure in step d), the filling step i) may be performed subsequently to any one of steps e)-h), as long as it is performed prior to step j) and after the transport closure is attached in step d).

Optionally, the filling step i) and the closing step j) are sequentially performed after steps a)-h) on a production line separate from steps a)-h).

By "body portion" and "lid collar portion" is meant the portions of the tube which will form the container body and the lid collar respectively after a slit or weakening means has been provided along the imaginary dividing line. The dividing line may also constitute of weakening means provided on the paperboard sheet material before being bent into the tube in step a), the weakening means thus co-extend along the dividing line.

Optionally, the slit or weakening means is formed simultaneously with forming the mating locking elements.

Optionally, the predetermined cross-sectional shape is a rectangular shape or a modified rectangular shape.

Optionally, the step g) comprises simultaneously forming the mating locking elements by embossing a part of the container body portion together with a side surface portion of the plug-in portion between a male shaping tool and an anvil having a corresponding recess, thereby forming the mating male and female locking elements.

Optionally, the method further comprises folding or rolling a top end edge of the tube inward over the peripheral flange at any point after attachment of the peripheral flange of the top disc to the inner surface of the lid collar portion.

The paperboard top disc may be provided with preformed folding lines and crease line facilitating folding along the fold lines before folding the top disc such that a peripheral flange is flexed and shaped.

A transport closure may be placed at a distance from the container opening of the container body which allows closure of the container lid comprising the plug-in portion. The distance between the transport closure and the container opening may be in the order of from 12 to 60 millimeters. If the transport closure is placed at a distance of from 30 to 60 millimeters from the main surface of the plug-in portion, the space above the transport closure may be used to accommodate a scoop or other utensil provided together with the packaged goods.

Depending on whether the transport closure is applied from the upper end of the container body or from the bottom end of the container body, the transport closure edges which are joined to the inner surface of the container wall will be directed upward toward the upper body opening or downward, toward the bottom body opening. In an assembled and filled packaging container made according to the method as disclosed herein, a peelable transport closure which is attached with the closure edges directed upward is more resistant to inadvertent peeling that may be caused by a higher pressure on the outside of the transport closure than inside the transport closure. On the other hand, a peelable transport closure which is attached with the closure edges directed downward is more resistant to inadvertent peeling that may be caused by a higher pressure on the inside of the transport closure than on the outside of the transport closure.

Closing of the bottom container body opening may for example be performed by folding, such as by bottom flaps being folded inwards and glued together, of by means of a bottom disc being attached to the bottom end edge or to the inner surface of the container body in the bottom end.

The flange, formed from the top disc outer edges being folded upwards is attached, with the flange edges directed upwards towards the top end, at the attachment portion to the inner surface of the lid collar portion. The attachment of the flange may be performed by gluing or welding, for instance with high frequency weld to the inner surface of the lid collar portion.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of materials are not necessarily drawn to scale. The packaging containers shown in the figures are provided as examples only and should not be considered limiting to the invention. Accordingly, the scope of invention is determined solely by the scope of the appended claims.

Figure 1A:
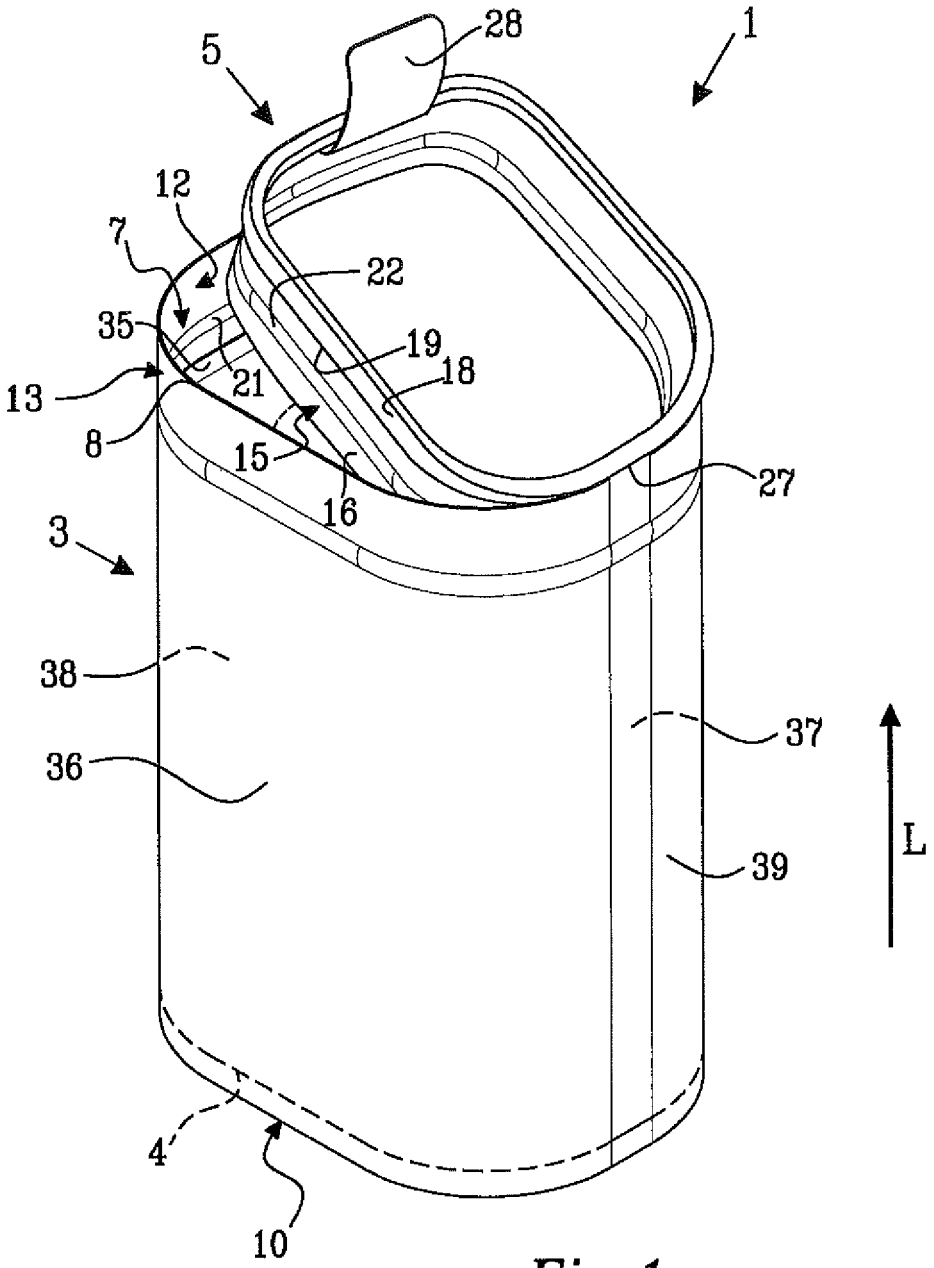
FIG. 1*a* illustrates a packaging container according to the present disclosure, with the container lid in an open position.
Figure 1B:
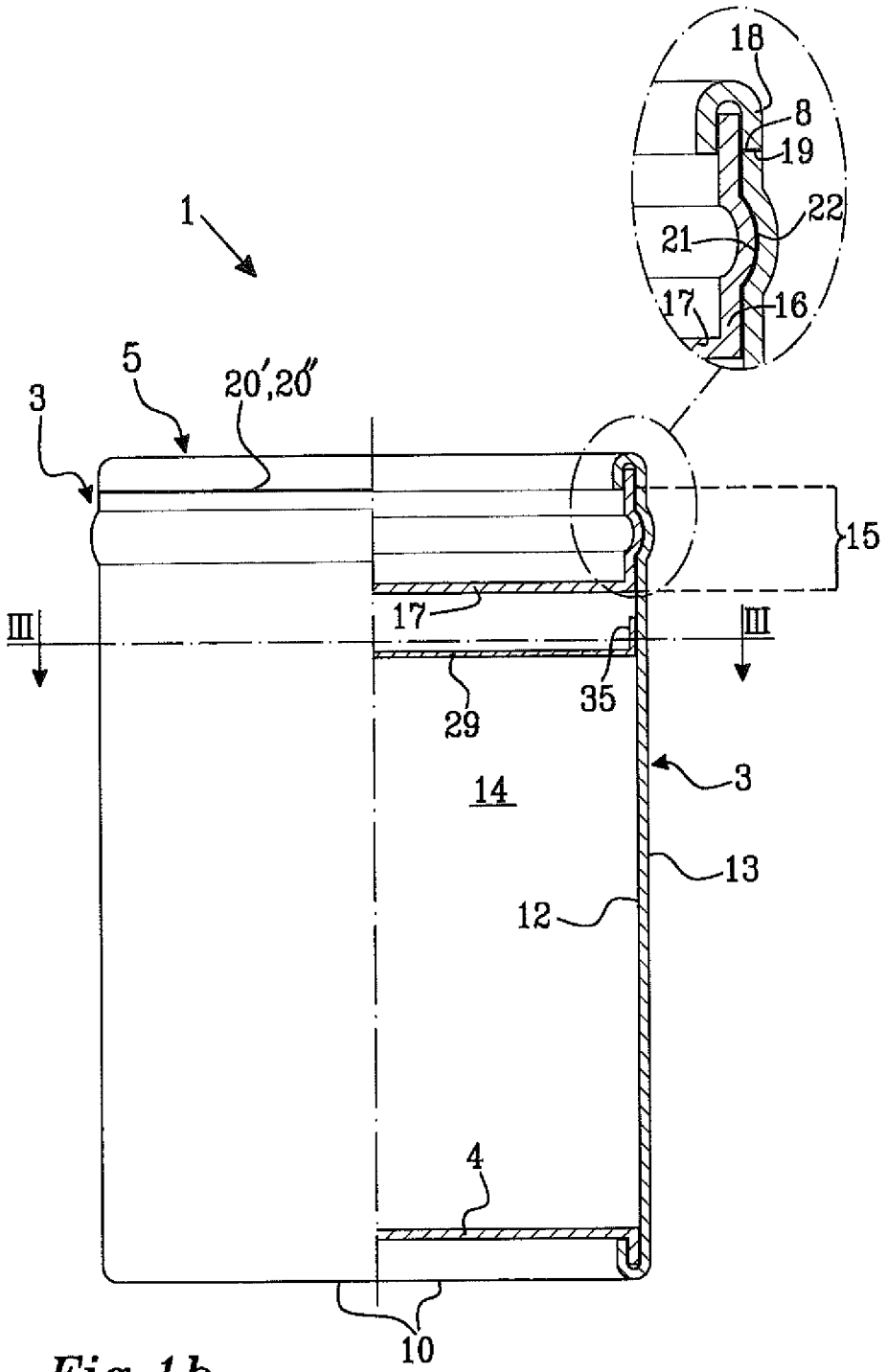
FIG. 1*b* illustrates a packaging container according to the present disclosure, with the container lid in a closed position, with a part of the packaging container illustrated in a cross-section view.

FIGS. 1*a* and 1*b* illustrate a paperboard packaging container 1 for bulk solids according to the present disclosure. The particular shape of the container 1 shown in the figures should not be considered limiting to the invention. Accordingly, a packaging container produced according to the invention may have any useful shape or size.

FIG. 1*a* illustrates the paperboard packaging container 1 in an open position and FIG. 1*b* illustrates the paperboard packaging container 1 in a closed position wherein a part of FIG. 1*b* is a cross-sectional view.

The paperboard packaging container 1 comprises a tubular paperboard container body 3, a container bottom 4 and a container lid 5. The container body 3 extends in a longitudinal direction (L) of the container 1 from a bottom end 10 of the container body 3 to a container opening 7. The container body 3 comprises a container body abutment edge 8 at the container opening 7. The container body 3 has an inner surface 12 facing towards an inner compartment 14 in the packaging container 1 and an outer surface 13 facing away from the inner compartment 14.

In FIG. 1*a* the container body having a cuboid shape is depicted. The paperboard container has a front wall portion 36, a rear wall portion 37, side wall portions 38,39 and curved corner portions connecting the wall portions. The curved corner portions have a radius of curvature of between 15 and 30 mm.

The front and rear wall portions 36, 37 may have an outwardly curved shape with a radius of curvature of from 30-400 mm, while the side wall portions are substantially planar.

The container lid 5 comprises an outer circumferential lid collar 18 having a lid abutment edge 19, which is adapted for abutting against the container body abutment edge 8, and a lid plug-in portion 15. The container lid 5 is also provided with a grip tab 28.

The plug-in portion 15 has a side surface 16 which extends in the longitudinal direction (L) and faces the inner surface 12 of the container body 3 when the container lid 5 is in a closed position. The plug-in portion 15 further comprises a main surface 17 being located at a distance from the container body abutment edge 8 when the container lid 5 is in a closed portion such that the plug-in portion 15 forms a plug extending downwards towards the container bottom 4.

The paperboard packaging container 1 is furthermore provided with a locking arrangement for retaining the container lid 5 in a closed position after closure of the lid 5. The locking arrangement according to FIG. 1 comprises a first locking element 21 in the form of a recess, provided on the inner surface 12 of the container body 3, and a second locking element 22 in the form of a mating protrusion, provided on the side surface 16 of the lid plug-in portion 15. However, the first locking element 21 may also be in the form of a protrusion and the second locking element 22 in the form of a recess, wherein the protrusion and the recess are matching such that the protrusion projects into the recess when the container lid 5 is in a closed position.

The first and second locking elements 21, 22 are arranged such that when the container lid 5 is in the closed position the protrusion is in engagement with the recess, i.e. the first locking elements 21, provided on inner surface 12 of the container body 3, is provided with the same distance from the container body abutment edge 8 as the second locking element 22, provided on the side surface 16 of the plug-in portion 15, is provide from lid abutment edge 19.

The mating locking elements 21, 22 illustrated in FIGS. 1*a* and 1*b* are in the form of an elongated continuous protrusion and an elongated continuous recess provided along substantially 100% of the periphery of the inner surface 12 of the container body 3 and the side surface 16 of the plug-in portion 15, respectively.

The packaging container 1 could also be provided with two or more of the locking arrangements, such that two or more of the first locking element 21 and two or more of the second locking element 22, would be arranged in parallel, spaced apart in the longitudinal direction, continuously or discontinuously, along the periphery of the inner surface 12 of the container body 3 and along the periphery of the side surface 16 of the plug-in portion 15, respectively.

The container body abutment edge 8 and the lid abutment edge 19 are in FIG. 1*a* are perpendicular to the wall of the container body 2 and have flat surfaces.

The container lid 5 is opened by pivoting the container lid about a hinge 27 provided between the container lid 5 and the container body 3. The hinge 27 is provided at one of the side wall portions.

The lid collar in FIG. 1*b* is delimited from the container body by a slit 20' or by weakening means 20", extending along at least 75%, of the container body periphery for allowing the lid collar to be fully or partially separated from the container body at the abutment edges 8,19.

In a packaging container 1 as disclosed herein, the lid 5 may be arranged to be completely removed when opening the container 1. When the container lid 5 is a completely removable lid, the container lid 5 is free from permanent connections to the container body 3. For the lid collar 18, and thus the container lid 5, to be fully separable from the container body, the slit 20' or the weakening means 20" should extend along 100% or substantially 100% of the container body 3 periphery.

The paperboard packaging container 1 is in FIGS. 1*a* and 1*b* provided with a partly removable transport closure 29 being attached to the inner surface 12 of the container body 3 at the transport closure peripheral flange 35. The transport closure 29 is removed by a user in order to gain initial access to the packaged content, leaving the peripheral flange 35 still attached to the inner surface 12 of the container body 3. The peripheral flange 35 acts as a reinforcement of the container opening 7 and stabilizes the shape of the container opening 7 such that the container 1 can be repeatedly opened and reclosed without the shape of the container opening 7 deteriorating over time. The stabilizing residual peripheral flange 35 contributes to maintaining a distinct closure even after the container 1 has been opened and closed multiple times. The transport closure 29 is provided at sufficient distance from a container body abutment edge 8 at said container opening 7 to allow the container lid 5 comprising the plug-in portion 15 to be in a closed position, meaning that this distance should be equal to or larger than the height of the plug-in portion 15.

As may be seen in FIG. 1*b* the container bottom 4 is in the form of a bottom disc provided in the bottom end 10, the bottom disc having a peripheral flange being flexed towards the bottom end 10 in the longitudinal direction (L). The attachment of the flange may be performed by gluing or welding, for instance with high frequency weld to the inner surface 12 of the container body 3. The bottom end edge is folded inwards over the bottom disc flange.

Figures 2A, 2B, 2C, 2D, 2E:
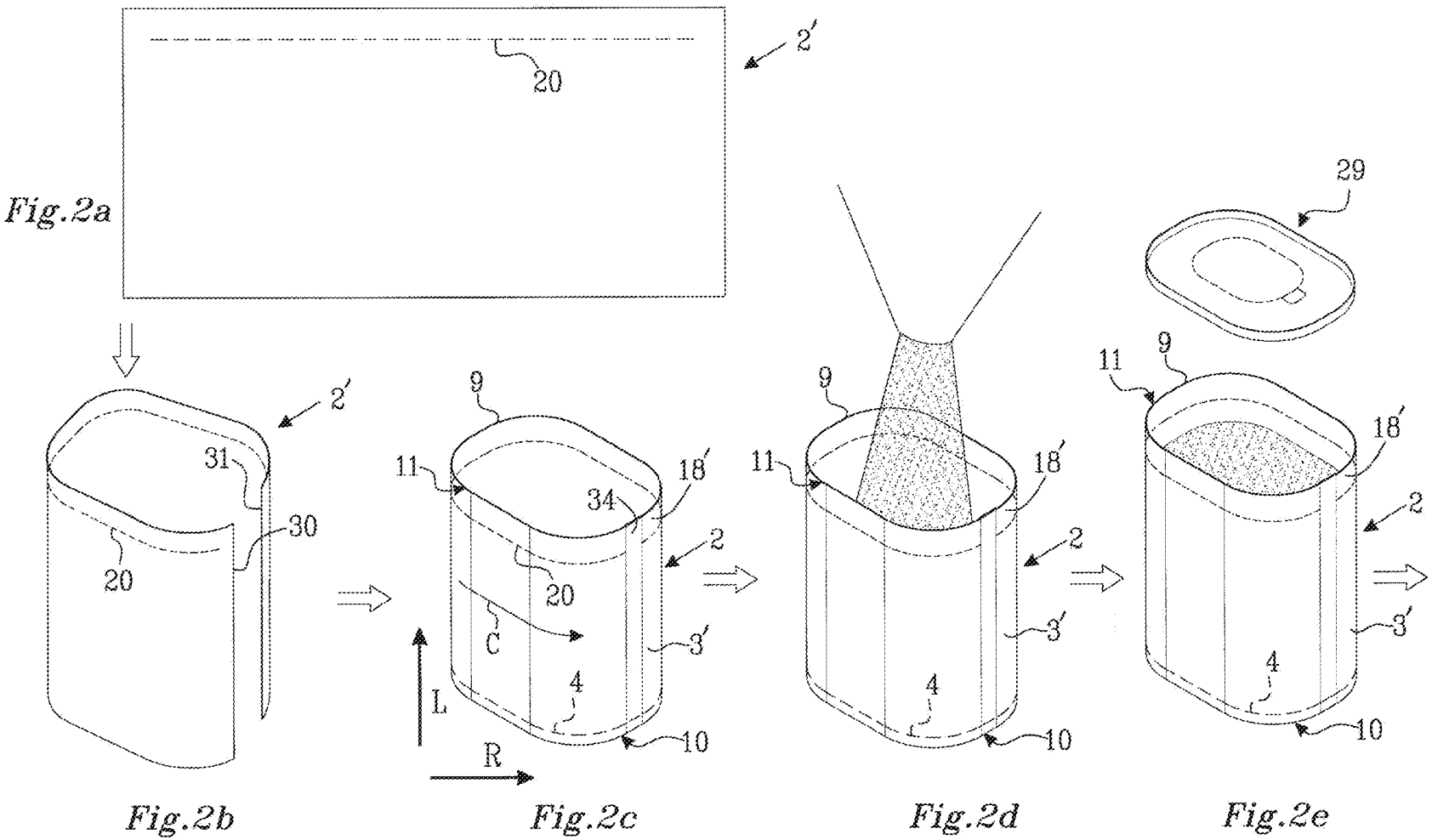
FIGS. 2*a-k* shows schematically a process for producing and filling the packaging container in FIG. 1.

A paperboard packaging container 1 as shown in FIGS. 1*a* and 1*b* may be produced by the method illustrated in FIGS. 2*a*-2*k*. The method involves bending a paperboard sheet material 2', shown in FIG. 2*a*, into a tube 2 by bending together the side edges 30,31 of the paperboard sheet material 2', thus causing the material to assume a tubular shape as shown in FIGS. 2*b* and 2*c*. The tube 2 has a longitudinal direction L, a radial direction R perpendicular to the longitudinal direction L, and a circumferential direction C. The side edges 30,31 of the paperboard sheet material 2' are then sealed together such that the tube 2 is closed in the longitudinal direction L. The side edges 30,31 may be joined overlapping or with the side edges 30,31 abutting. The sealing of the side edges may be made by any suitable method as known in the art, such as by welding or gluing, with welding being preferred. In the process shown in FIG. 2, and more specifically in FIG. 2*c*, the side edges 30,31 of the container body sheet 2' are sealed using a sealing strip 34. The use of a sealing strip 34 is optional to the invention.

The bottom end is closed by a container bottom 4 in the form of a bottom disc. However, the closure may also be replaced by a folded bottom portion, as known in the art.

The resulting closed tube 2 has a top end 11 and a bottom end 10 and comprises a container body portion 3' and a lid collar portion 18', the lid collar portion 18' being arranged at the top end 11 and being delimited from the body portion 3' by an dividing line extending in the circumferential direction C between the body portion 3' and the lid collar portion 18'. The dividing line 20 may be an imaginary line delimiting the tube 2 in a body portion 3' and a lid collar portion 18' which are to form the container body 3 and lid collar 18 in the method according to this disclosure. However, the paperboard sheet material 2' may also be provided with weakening means 20" before being bent into a tube 2 such that the weakening means 20" co-extends with the dividing line 20 delimiting the tube 2 in a body portion 3' and a lid collar portion 18' which are to form the container body 3 and lid collar 18 on the packaging container 1 according to the present disclosure.

FIG. 2*d* illustrates introducing the container body to a filling station for filling of the container body portion 3' with bulk solids through the opening at the top end 11. The filling step of the container body portion 3' may either be made by filling the container body portion 3' from the top end 11 after the bottom end 10 has been closed, or alternatively from the bottom end 10 after closing of the tube 2 at the top end 11. In FIG. 2*e*, a transport closure 29 is attached to the inner surface of the container body portion 3' at the top end 11 of the tube 2. The transport closure 29 is partially removable by means of a pull-tab.

Figure 2H:
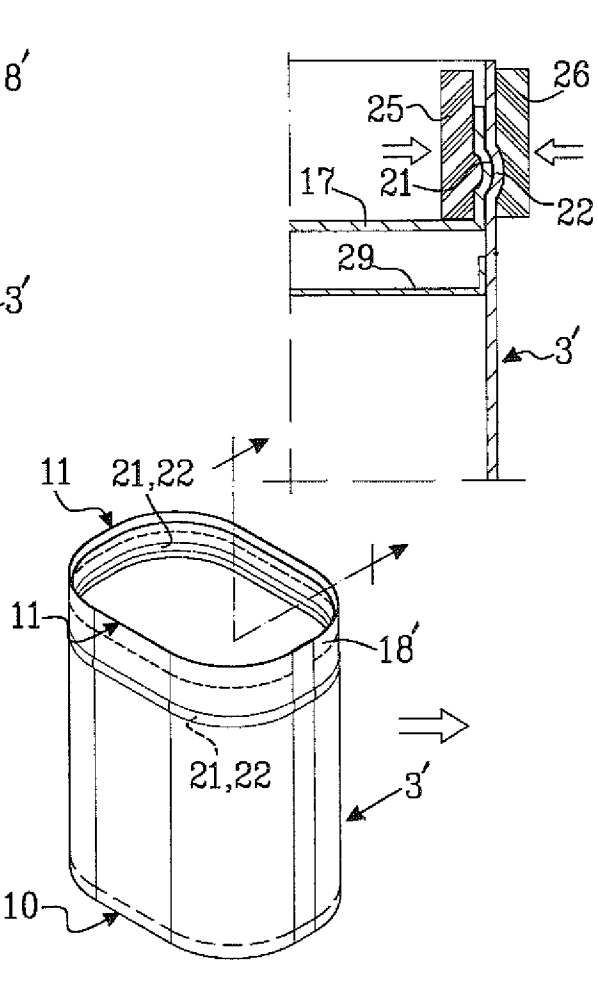
Figure 2G:
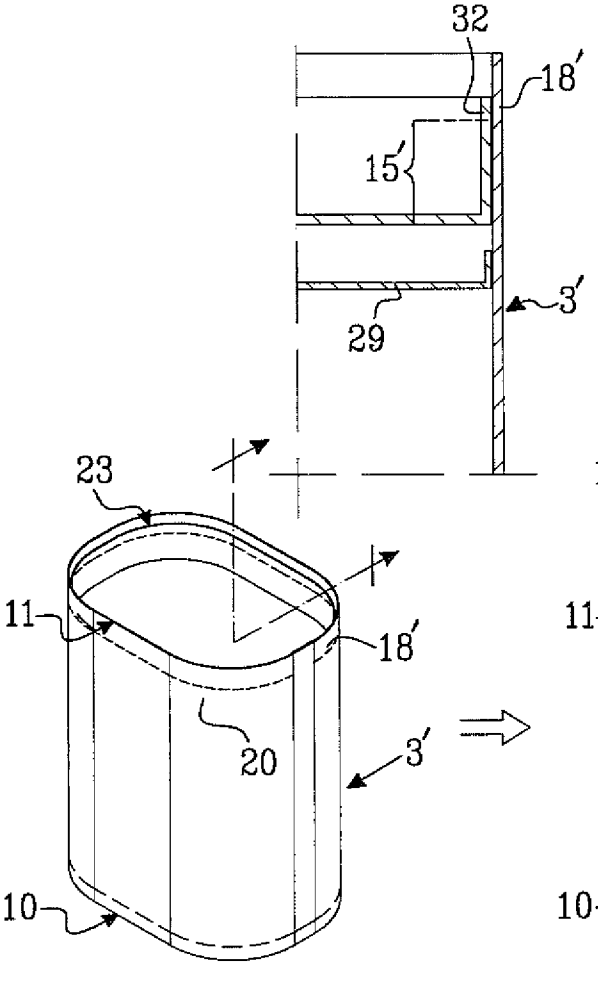
Figure 2F:
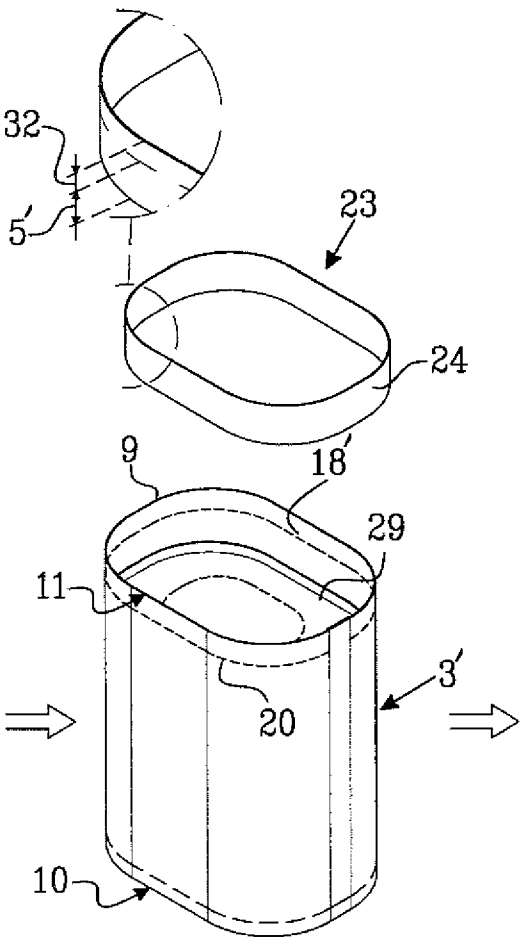

FIG. 2*f*-*g* illustrates closing of the tube 2 at the top end 11 by applying a paperboard top disc 23 into the tube 2 at the top end 11. The size ratio of said top disc 23 surface area to the surface area of the opening of the tube 2 at the top end 11 is at least 1.05, such that an outer edge portion of the top disc 23 is flexed and shaped when the top disc 23 is pressed into opening of the tube 2 at the top end 11. Alternatively and as shown in this FIG. 2*f*, the top disc 23 is pre-formed, such that the outer edge portion already is flexed and shaped to a peripheral flange 24 projection out of a main plain of the top disc before being pressed into the opening of the tube 2 at the top end 11. As seen in FIG. 2*g*, the flange 24 extends in the longitudinal direction L across the dividing line 20, and has an attachment portion 32 positioned at the lid collar portion 18', which portion will form the lid collar 18 on the container lid 5. The flange 24 is aligned with the inner surface 7 of the container body 3 with the a part of the top disc 23, including the flange 24, being located on the container body portion 3' side of the dividing line 20 forming a plug-in portion 15. The plug-in portion 15 having a side surface 16 extending in the longitudinal direction L and a main surface 17.

The peripheral flange 24 of the paperboard top disc 23 is attached to the inner surface of the lid collar portion 18' of the tube 2 at the attachment portion 32 of the peripheral flange 24. The attachment portion 32 of the peripheral flange 24 is the portion of the peripheral flange 24 facing the portion of the tube 2 above the dividing line 20, i.e. the lid collar portion 18' of the tube 2.

The attachment of the peripheral flange 24 may be performed prior or simultaneously to forming the locking arrangement. However, it could also be performed after forming the locking arrangement, as long as it is made prior or simultaneously to a step of arranging the slit 20.

FIG. 2*h* illustrates the step in which a locking arrangement is provided at the container body portion. The locking arrangement comprises a first locking element 21 provided at the inner surface of the container body portion 3' and a second locking element 22 provided at the side surface 16 of the plug-in portion 15, and is provided to the container body portion 3' and to the plug-in portion 15 by physically deforming the paperboard material 2' in the container body portion 3' and in the plug-in portion 15 by embossing a part of the container body portion 3' and the plug-in portion 15 between a male shaping tool 25 and an anvil 26 having a corresponding recess and thereby forming mating male and female locking elements 21,22. The male shaping tool 25 may be in the form of a pressing foot comprising an expandable portion pressing towards the peripheral flange 24, but the male shaping tool 25 and the anvil 26 may be any types of metal dies, the male shaping tool 25 having a raised surface and the anvil 26 having a mating surface recessed into it, wherein the two dies fit into each other. The container body portion 3' and the plug-in portion 15 are applied between the male shaping tool 25 and the anvil 25 and then heat and pressure are applied to squeeze the raised portion on the male shaping tool 25 into the recessed portion of the anvil 26.

Figure 2K:
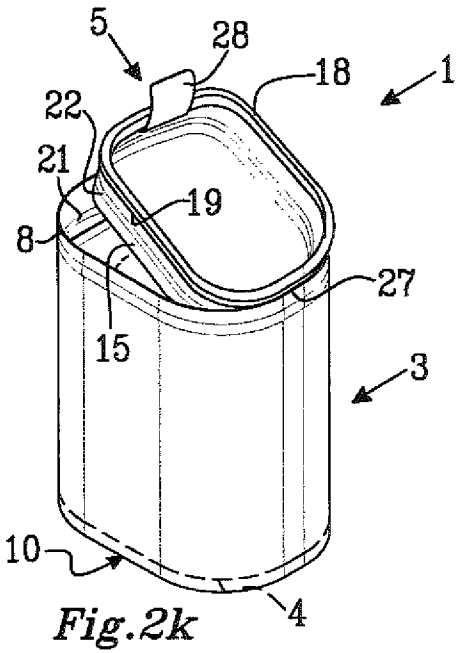
Figure 2J:
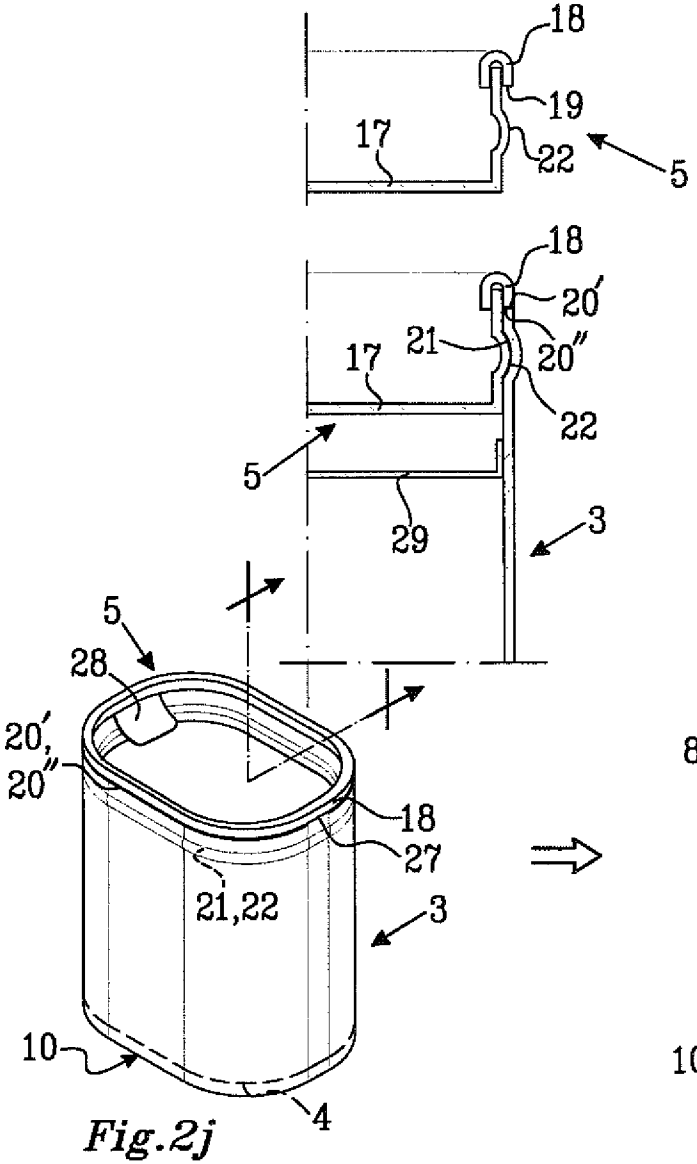
Figure 2I:
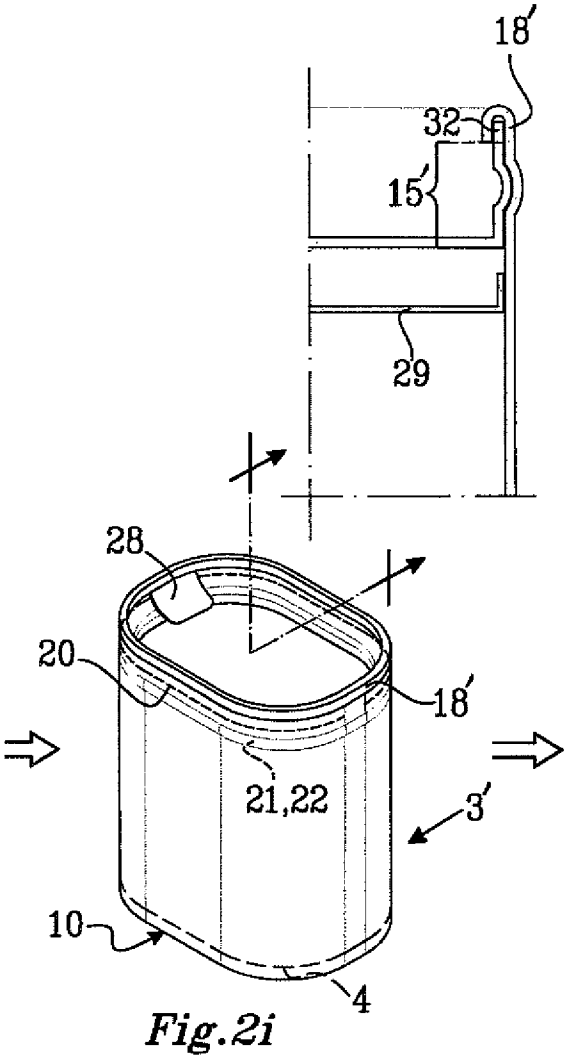

FIG. 2*i* illustrates that a top end edge 9 of the tube 2 has been folded or rolled inwards over the peripheral flange 24. This folding or rolling inwards of the top end edge 9 over the peripheral flange 24 is an optional step which may be made at any point after attachment of the peripheral flange 24 of the top disc 23 to the inner surface of the lid collar portion 18.

FIG. 2*j* shows packaging container 1 provided with a slit 20' or weakening means 20" extending along 75-95% of the dividing line. The slit 20' or weakening means 20" may be arranged along the dividing line 20 before or after forming the tube 2. The remaining part of the periphery not comprising the slit 20' or the weakening means 20" provided between the container lid 5 formed and the container body 3, provides the packaging container 1 with a hinge 27. The hinge 27 may be provided with a hinge crease line extending along the imaginary dividing line 20. The hinge 27 is arranged between the container body 3 and the container lid 5 at one of the side walls of the packaging container 1.

The provision of the slit 20' or weakening means 20" allows allowing opening of the container top 5 comprising the container lid top member 18 and the lid plug-in portion 15, fixedly connected to the lid top member 18 at the attachment portion 32 by means of wither gluing or a weld seal. The container lid top member 18 and the container body 2 are provided with a top member abutment edge 19 and a container body abutment edge 8, respectively, by means of the slit 20' or by separating the lid top member 18 from the container body 3 at the weakening means 20" upon opening of the container top (5), as shown in FIG. 2*k*, showing the packaging container 1 with the container lid 5 in an open position.

However, the slit 20' or the weakening means 20" may also be provided along only 10-50% allowing only partial opening of the container lid 5 may normally only be partially opened. In such case the main surface 17 of the plug-in portion 15 may comprise a pivotable hinged lid portion and the side surface 16 of the plug-in portion 15 are provided with slits to allow separation of the pivotable hinged lid portion.

Figure 3:
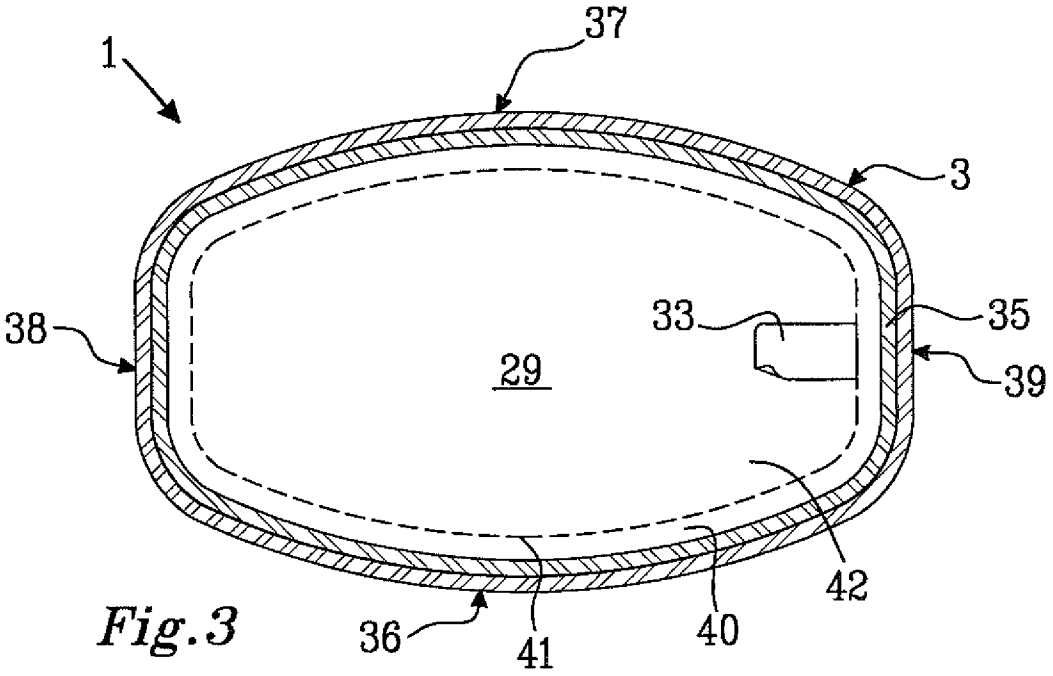
FIG. 3 illustrates a cross-sectional view of the packaging container according to line III-III in FIG. 1*b*.

FIG. 3 shows a cross-sectional view of the packaging container 1 taken from lines III-III in FIG. 1*b*, wherein the cross section of the packaging container 1 has a modified rectangular shape. The opposing front and rear wall portions 36, 37 each has a convex shape, the corner portions are curved and the opposing side wall portions 38, 39 are straight. The transport closure 29 is applied in the packaging container with the transport closure peripheral flange 35 flexed towards the top end of the packaging container 1.

The transport closure 29 is furthermore provided with a tear line 41 and a pull-tab 33 for facilitated opening of the transport closure 29. A peripheral edge portion 40 surrounds a tear-open part 42, which is delimited from the peripheral edge portion 40 by the tear line 41. As illustrated in this figure, the front and rear wall portions 36,37 are wider than the side wall portions 36,37.

The transport closure may also be provided with cuts, forming a tear strip and a tear-away area which includes the tear strip. By pulling at the tear-strip formed in the top member, the connection or connections between the top member and the bottom member within the area constituted by the tear strip will cause the bottom member to break along the cuts in the top member. Thereby, both the top member and the bottom member within the tearable area can be removed from the container and to make the contents in the container available for use.

The invention claimed is:

1. A paperboard packaging container for bulk solids, said container comprising:

a tubular paperboard container body, a container bottom, and a paperboard container lid, said container body extending in a longitudinal direction of said container from a bottom end of said container body to a container opening, said container body comprising a container body abutment edge at said container opening, said container body having an inner surface facing towards an inner compartment in said packaging container and an outer surface facing away from said inner compartment, said container lid comprising a lid collar having a lid abutment edge adapted for abutting against said container body abutment edge when said container lid is in a closed position, and a plug-in portion, said plug-in portion having a side surface, extending in said longitudinal direction and facing said inner surface of said container body when said container lid is in said closed position, and a main surface extending along a bottom of said container lid, said main surface of said plug-in portion being located at a distance from said container body abutment edge when said container lid is in said closed position, wherein a peripheral flange of the container lid extends from the main portion of the plug-in portion and the side surface of the plug-in portion comprises at least a portion of the peripheral flange, wherein said lid collar is made of the same material as the container body and said lid collar is delimited from said container body by a slit or by weakening means for allowing said lid collar to be fully or partially separated from said container body at said abutment edges, and wherein the lid collar is folded over the peripheral flange so that the lid collar is in face-to-face contact with an interior surface of the peripheral flange and with an exterior surface of the peripheral flange, said packaging container being provided with a locking arrangement for retaining said container lid in said closed position, a hinge provided between the container lid and the container body so that the container lid is opened by pivoting the container lid about the hinge, a reinforcement of the container opening is provided by at least one of:

(i) a partially removable transport closure being attached to said inner surface of said container body and forming a roof over said inner compartment; or (ii) by said container body being formed from a multiply paperboard material including at least one or more reinforcing non-cellulosic layer; and wherein said locking arrangement comprises a first locking element in the form of an elongated continuous recess, provided on said inner surface of said container body, and a second locking element in the form of an elongated continuous protrusion provided on said side surface of said plug-in portion, said first and second locking elements being mating locking elements formed by simultaneous deformation of the inner surface of the container body and the side surface of the plug-in portion of the lid, wherein said first locking element and said second locking element are arranged such that when said container lid is in said closed position said protrusion is in engagement with said recess, and the first locking element and the second locking element are spaced upwardly in the longitudinal direction from the main surface of the plug-in portion along respective perimeters of the first locking element and the second locking element and are spaced downwardly in the longitudinal direction from the lid collar along the respective perimeters of the first locking element and the second locking element.

2. The paperboard packaging container according to claim 1, characterized in that said paperboard packaging container comprises at least two of said locking arrangement being spaced apart in said longitudinal direction.

3. The paperboard packaging container according to claim 1, characterized in that said first and second mating locking elements form a snap lock connection.

4. The paperboard packaging container according to claim 1, characterized in that upon closure of said container lid into said closed position, such that said protrusion comes into engagement with said recess, an audible signal in the form of a click sound is produced.

5. The paperboard packaging container according to claim 1, characterized in that said first locking element and said second locking element are in the form of physical deformations of the paperboard material provided on said inner surface of said container body and said side surface of said plug-in portion, respectively.

6. The paperboard packaging container according to claim 1, characterized in that said hinge comprising or consisting of a remaining part of the periphery not comprising said slit or said weakening means.

7. The paperboard packaging container according to claim 1, characterized in that said locking arrangement and said hinge are arranged at opposite sides of said container opening.

8. The paperboard packaging container according to claim 1, characterized in that said container body comprises opposing front and rear wall portions and opposing side wall portions and that the cross-section of said paperboard packaging container has a rectangular shape or a modified rectangular shape.

9. The paperboard packaging container according to claim 8, characterized in that said locking arrangement and said hinge are provided on respective side wall portions that are opposite to one another.

10. The paperboard packaging container according to claim 1, characterized in that said container body comprises wall portions and curved corner portions, said curved corner portions having a radius of curvature of from 10-65 mm, and that said first locking element is provided on said inner surface of said container body in at least one of said curved corner portions.

11. The paperboard packaging container according to claim 1, wherein the container lid is provided with a grip tab.

12. The paperboard packaging container according to claim 1, characterized in that said side surface of said plug-in portion has a height (h1) of between 10-50 mm, as measured from said main surface of said plug-in portion to said abutment edge of said lid collar.

13. The paperboard packaging container according to claim 1, characterized in that said transport closure is a paperboard transport closure.

14. The paperboard packaging container according to claim 1, characterized in that said transport closure comprises a peripheral edge portion partially or fully surrounding a tear-open part, said tear-open part being delimited to said peripheral edge portion by a tear line.

15. The paperboard packaging container according to claim 1, characterized in that said reinforcing non-cellulosic layer is chosen from a polymeric film or coating and/or metal foil.

* * * * *